United States Patent [19]

Mabe

[11] Patent Number: 4,470,778

[45] Date of Patent: Sep. 11, 1984

[54] SCROLL TYPE FLUID DISPLACEMENT APPARATUS WITH OIL SEPARATING MECHANISM

[75] Inventor: Atsushi Mabe, Isesaki, Japan

[73] Assignee: Sanden Corporation, Gunma, Japan

[21] Appl. No.: 306,661

[22] Filed: Sep. 29, 1981

[30] Foreign Application Priority Data

Nov. 10, 1980 [JP] Japan ..... 55-158742

[51] Int. Cl.[3] ..... F04C 18/02; F04C 29/02; B01D 45/06; B01D 50/00

[52] U.S. Cl. ..... 418/55; 418/DIG. 1; 55/323; 55/437

[58] Field of Search ..... 418/55, 89, 98, 100, 418/DIG. 1; 55/323, 437, 438

[56] References Cited

U.S. PATENT DOCUMENTS

| | | | |
|---|---|---|---|
| 1,405,259 | 1/1922 | Beach | 55/323 |
| 1,509,917 | 9/1924 | Westinghouse | 418/DIG. 1 |
| 1,854,692 | 4/1932 | Cooper | 418/DIG. 1 |
| 3,684,412 | 8/1972 | Harlin et al. | 418/89 |
| 3,852,003 | 12/1974 | Adalbert et al. | 418/DIG. 1 |
| 4,332,535 | 1/1982 | Terauchi et al. | 418/DIG. 1 |
| 4,340,339 | 7/1982 | Hiraga et al. | 418/98 |
| 4,343,599 | 8/1982 | Kousokabe | 418/DIG. 1 |

FOREIGN PATENT DOCUMENTS

| | | | |
|---|---|---|---|
| 2822780 | 12/1978 | Fed. Rep. of Germany | 418/DIG. 1 |
| 37521 | 3/1980 | Japan | 418/55 |

*Primary Examiner*—John J. Vrablik

*Attorney, Agent, or Firm*—Banner, Birch, McKie & Beckett

[57] ABSTRACT

A scroll type fluid displacement apparatus including a housing divided into a discharge chamber and a suction chamber is disclosed. A fixed scroll member is disposed within the housing and comprises a first end plate and a first wrap which extends from one end surface of the first end plate. The discharge chamber is formed adjacent the fixed scroll member on the side of the first end plate opposite the side thereof from which the first wrap extends. An annular shaped dividing wall is formed at the end surface of the first end plate and extends into the interior of the discharge chamber. The discharge chamber is partitioned into two chambers by the dividing wall. At least one hole is formed through the dividing wall to connect the two chambers of the discharge chamber. The dividing wall is provided with a deflecting member for bending the fluid flow of the discharging fluid. At least one oil separating member is disposed in a fluid passageway upstream of a fluid outlet port from the housing. The separation of lubricating oil from the discharging fluid is promoted and the outflow of the oil is minimized.

49 Claims, 9 Drawing Figures

FIG. 7.
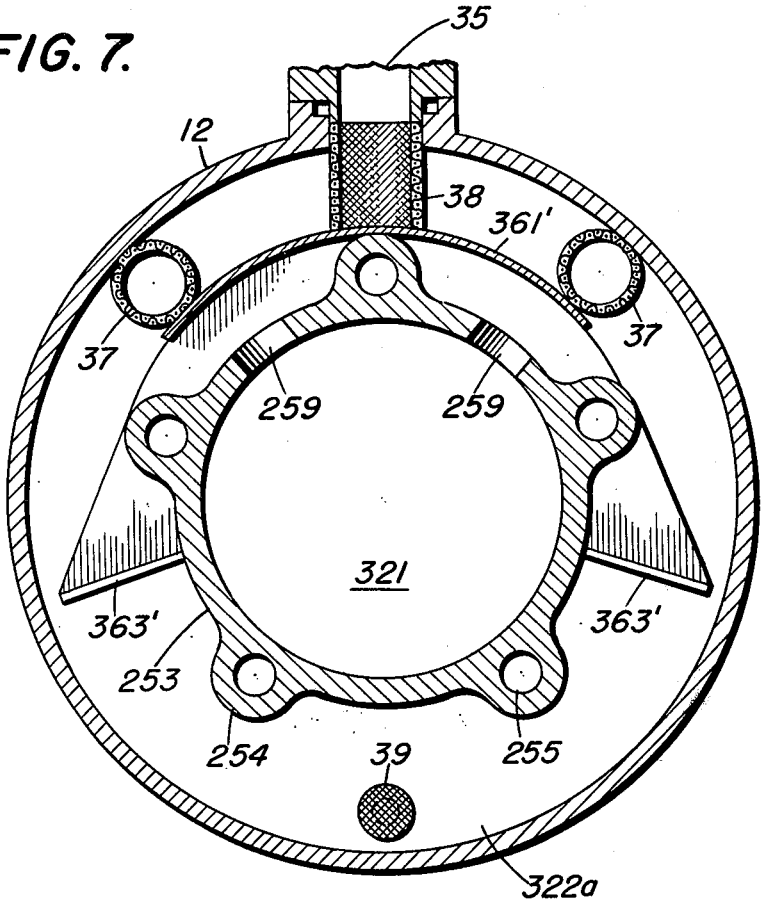
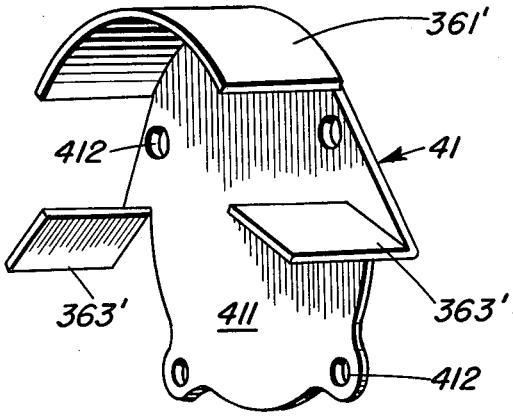
FIG. 8

SCROLL TYPE FLUID DISPLACEMENT APPARATUS WITH OIL SEPARATING MECHANISM

BACKGROUND OF THE INVENTION

This invention relates to fluid displacement apparatus, and in particular to fluid compressor units of a scroll type.

Scroll type fluid displacement apparatus are well known in the prior art. For example, U.S. Pat. No. 801,182 disclosed a scroll-type fluid displacement including two scroll members each having a circular end plate and a spiroidal or involute spiral element. These scroll members are maintained angularly and radially offset so that spiral elements interfit to make a plurality of line contacts between both spiral curved surfaces, thereby to seal off and define at least one pair of fluid pockets. The relative orbital motion of the two scroll members shifts the line contact along the spiral curved surfaces and, therefore, the fluid pockets change in volume. The volume of the fluid pockets increases or decreases dependent the direction of the orbital motion. Therefore, the scroll type fluid displacement apparatus is applicable to compress, expand or pump fluids.

In a conventional refrigerant compressor, a charge of refrigerant fluid and lubricating oil is introduced. The fluid is compressed by the orbital motion of a scroll member and the compressed fluid is fed out of compressor unit to an external fluid circuit. Lubricating oil is splashed up in the interior of the compressor housing to lubricate desired components of compressor. The splashed up lubricating oil mixes with the fluid and flows out of the compressor unit with the compressed fluid. The part of lubricating oil which flows out of the compressor unit with the compressed fluid adheres to the inner surface of ducts in the external fluid circuit.

It is desirable in the operation of such a compressor unit that the amount of lubricating oil circulating in the compressor be appropriate for the compressor operating speed. Moreover, it is genrerally desirable to utilize a minimum amount of lubricating oil and to minimize the discharge or outflow of lubricating oil from the compressor unit to the external fluid circuit. The reduction of the oil discharge increases the operating efficiency of the condenser or evaporater of the heat exchanger with which the compressor is used.

SUMMARY OF THE INVENTION

It is a primary object of this invention to provide an improvement in a fluid displacement apparatus, in particular a compressor unit of the scroll type, which has an oil separating mechanism for separating lubricating oil from the compressed fluid.

It is another object of this invention to provide an improvement in a fluid displacement apparatus, in particular a compressor unit of the scroll type, wherein moving parts are efficiently lubricated by the separated lubricating oil.

It is still another object of this invention to provide an improvement in a fluid displacement apparatus, in particular a compressor unit of the scroll type, which is simple to construct and accomplishes the above described objects.

A scroll-type fluid displacement apparatus according to this invention includes a housing having a fluid inlet port and a fluid outlet port. A fixed scroll member is fixedly disposed within the housing and has a first end plate from which a first involute wrap extends. An orbiting scroll member has a second end plate from which a second involute wrap extends. The first and second involute wraps interfit at an angular and radial offset to make a plurality of line contacts to define at least one pair of fluid pockets. A driving mechanism which includes a drive shaft extends into and is rotatably supported by the housing. The driving mechanism effects an orbital motion of the orbiting scroll member by the rotation of the drive shaft while the rotation of orbiting scroll member is prevented. The fluid pockets change volume due to the orbital motion of the orbiting scroll member. The housing has a discharge chamber adjacent the fixed scroll member on the side of the first end plate opposite the side thereof from which the first wrap extends. The first end plate has an annular wall which extends into the interior of the discharge chamber and has at least one hole through its peripheral surface. The discharge chamber is partitioned into two chambers by the annular wall and both chambers are connected by the hole through the annular wall. The annular wall is provided with a deflecting member for bending the fluid flow direction of fluid being discharged. The deflecting member has a plurality of outlets which are placed angularly displaced from the hole through the annular wall. At least one oil separating member is disposed in the passageway of discharging fluid.

In one embodiment of this invention, the deflecting member comprises an arc-shaped plate extending circumferentially to cover the hole through annular wall and having two connecting holes. A fitting portion and a flange member are attached to the arc-shaped plate. The fitting portion is secured about thickened portions of the outer surface of annular wall to dispose the arc-shaped plate radially spaced from the annular wall. Two oil separating members are disposed between the inner surface of the housing and the outer surface of arc-shaped plate. Each of the oil separating members are placed near a connecting hole of arc-shaped plate. Another oil separating member is disposed at the entrance of the outlet port.

In another embodiment of this invention, the arc-shaped plates and a flange member are connected to a flat plate member. The flat plate member is disposed between an axial end surface of the annuluar wall projection and the inner surface of the housing. The deflecting means is thereby fixedly disposed in the discharge chamber.

In still another embodiment of this invention, the arc-shaped member and flange member are formed integral with the annular wall or the housing. The oil separating member is disposed between the inner surface of the arc shaped portion and the outer surface of the annular wall projection.

Further objects, features and other aspects of this invention will be understood from the following detailed description of the preferred embodiments of this invention referring to the annexed drawings.

BRIEF DESCRIPTION OF THE DRAWINGS

FIG. 7 is a sectional view similar to FIG. 6 of a compressor according to another embodiment of this invention;

FIG. 8 is a perspective view of the deflecting member in the embodiment of FIG. 7.

DETAILED DESCRIPTION OF THE PREFERRED EMBODIMENT

Figure 1:
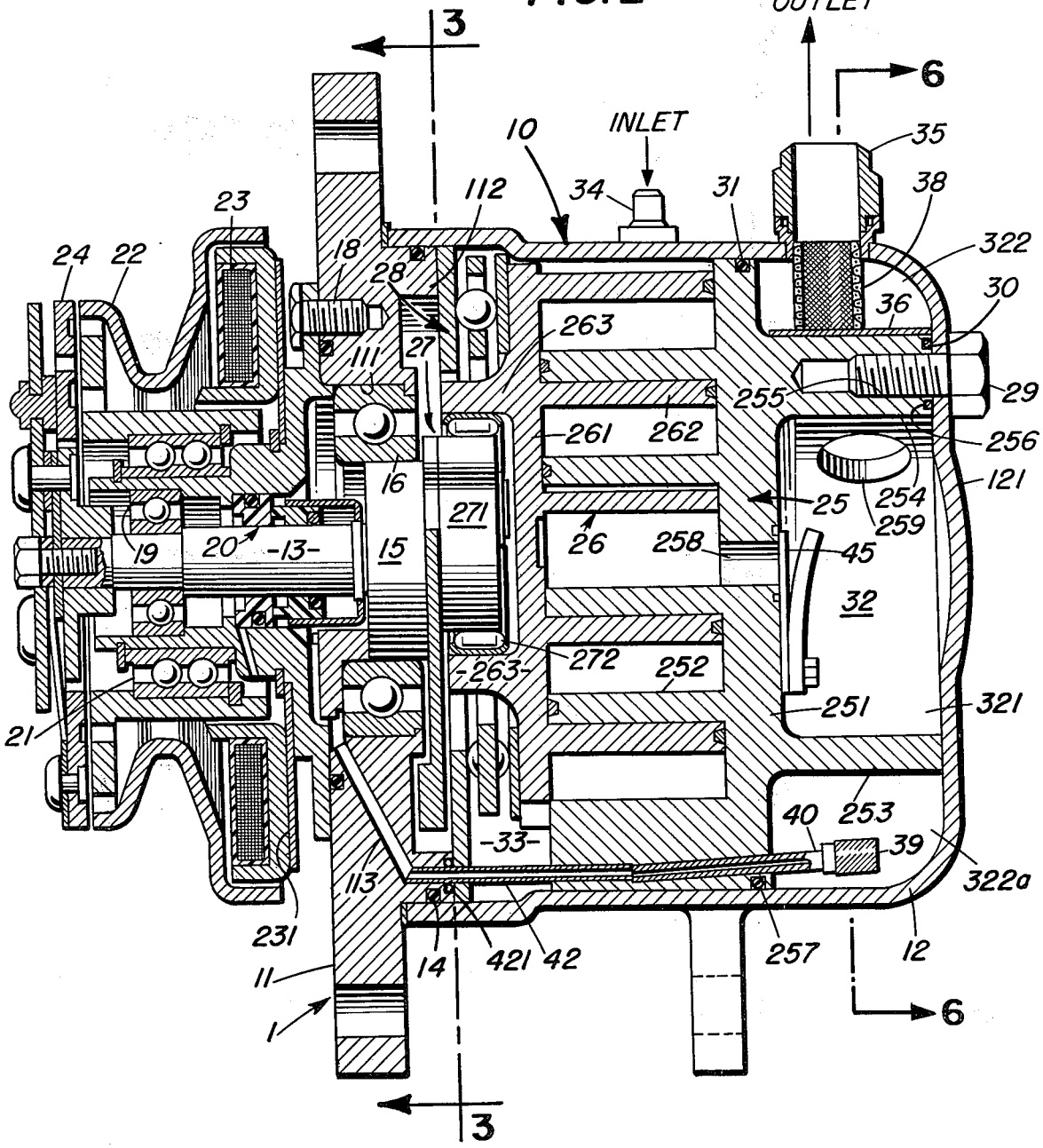
FIG. 1 is a vertical sectional view of a compressor unit according to one embodiment of this invention.

Referring to FIG. 1, a fluid displacement apparatus in accordance with the present invention, in particular, one embodiment of a scrolltype referigerant compressor unit 1 is shown. The unit includes a compressor housing 10 comprising a front end plate member 11 and a cup shaped casing 12 which is connected to an end surface of front end plate member 11. An opening 111 is formed in center of front end plate member 11 for penetration or passage of a drive shaft 13. An annular projection 112 is formed in a rear end surface of front end plate member 11. The annular projection 112 faces cup shaped portion 12 and projects concentric with opening 111. An outer peripheral surface of annular projection 112 fits within an inner surface of an opening portion of cup shaped casing 12. Cup shaped casing 12 is fixed to front end plate member 11 by a suitable fastening mechanism. The opening portion of cup shaped casing 12 is thereby covered by front end plate member 11. A seal member, such as O-ring 14, is placed between outer peripheral surface of annular projection 112 of front end plate member 11 and the inner wall of cup shaped casing 12, to thereby secure a seal between fitting or mating surface of cup shaped casing 12 and front end plate member 11.

Drive shaft 13 is formed with a disk rotor 15 at its inner end portion. Disk rotor 15 is rotatably supported by front end plate member 11 through a bearing 16 held within opening 111 of front end plate member 11. Front end plate member 11 has an annular sleeve portion 17 projecting from a front end surface thereof for surrounding drive shaft 13 to define a shaft seal cavity. In this embodiment, as shown in FIG. 1, sleeve portion 17 is formed separate from front end plate member 11. Therefore, sleeve portion 17 is fixed to the front end surface of front end plate member 11 by a plurality of screws 18, one of which is shown in FIG. 1. Alternatively, sleeve portion 17 may be formed a integral with front end plate member 11. A bearing 19 is placed within an outer end portion of sleeve portion 17 and rotatably supports drive shaft 13. A shaft seal assembly 20 is assembled on drive shaft 13 within the shaft seal cavity defined by sleeve portion 17.

A pulley 22 is rotatably supported by a bearing 21 which is attached to an outer surface of sleeve portion 17. An electromagnetic annular coil 23 is fixed to the outer surface of sleeve portion 17 by a support plate 231 and is received in an annular cavity of pulley 22. An armature plate 24 is elastically supported on the outer end of drive shaft 13 which extends from sleeve portion 17. A magnetic clutch comprising pulley 22, magnetic coil 23 and armature plate 24 is thereby formed. Thus, drive shaft 13 is driven by an external power source, for example, a motor of a vehicle through a belt and pulley 22.

A fixed scroll member 25, an orbiting scroll member 26, a driving mechanism 27 of orbiting scroll member 26 and a rotation preventing/thrust bearing mechanism 28 are disposed in an inner chamber of cup-shaped casing 12. The inner chamber is formed between the inner wall of cup shaped casing 12 and front end plate member 11.

Fixed scroll member 25 includes a circular end plate 251, and a involute wrap or spiral element 252 affixed to or extending from one major side surface of circular plate 251. Circular plate 251 of fixed scroll member 25 is formed with an annular partition wall 253 axially projecting from a major side surface opposite to the side thereof from which spiral element 252 extends. Partition wall 253 is provided with a plurality of thickened portions at equiangular spaces to form a plurality of legs portions 254. A tapped hole 255 is formed in each leg portion 254 to receive a screw 29. An annular groove 256 is formed in an end surface of each leg portion 254 for receiving first seal members 30. An end surface of each leg portion 254 is fitted against the inner surface of an end plate portion 121 of cup shaped casing 12. The leg portions 254 are fixed to end plate portion 121 of cup-shaped casing 12 by screws 29 (one of which is shown in FIG. 1) which screw into the tapped hole 255 of leg portions 254 from the outside of end plate portion 121. Seal members 30 are thus disposed between the end surface of each leg portion 254 and the inner surface of end plate portion 121, to thereby prevent fluid leakage along screws 29. Fixed scroll member 25 is thereby fixedly disposed within cup shaped casing 12. An annular groove 257 is formed on the outer peripheral surface of circular plate 251 and a second seal member 31 is disposed therein to form a seal between the inner surface of cup shaped casing 12 and the outer peripheral surface of circular plate 251.

The inner chamber of cup shaped casing 12 is partitioned into two chambers by circular plate 251, i.e., a discharge chamber 32 in which partition wall 253 is disposed and a suction chamber 33 in which spiral element 252 is disposed.

Orbiting scroll member 26 is disposed in suction chamber 33 and also comprises a circular end plate 261 and an involute wrap or spiral element 262 affixed to or extendng from a one side surface of circular end plate 261. Spiral elements 252, 262 interfit at an angular offset of 180° and predetermined radial offset. A pair of sealed off fluid pockets are thereby defined between both spiral elements 252, 262. Orbiting scroll member 26 is connected to the driving mechanism and to a rotation preventing/thrust bearing mechanism. These last two mechanisms effect orbital motion of the orbiting scroll member 26 at a circular radius Ro by the rotation of drive shaft 13, to thereby compress fluid passing through the compressor unit.

Figure 2:
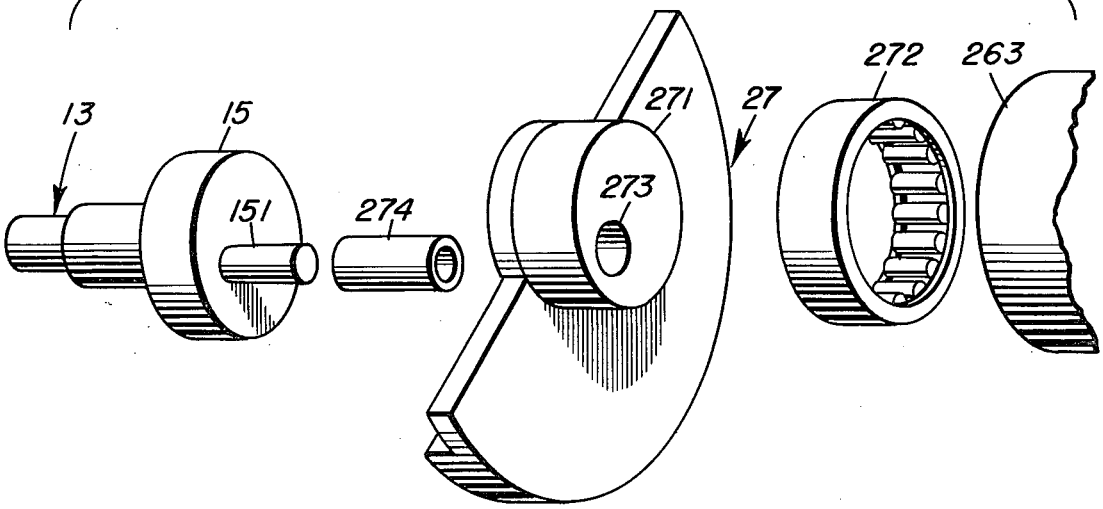
FIG. 2 is an exploded perspective view of a driving mechanism in the embodiment of FIG. 1.

Referring to FIG. 1 and FIG. 2, a driving mechanism of orbiting scroll member 26 will be described. Drive shaft 13, which is rotatably supported by sleeve portion 17 through bearing 19, has disk rotor 15 at its inner end. Disk rotor 15 is also rotatably supported by front end plate member 11 through bearing 16. A crank pin or drive pin 151 projects axially from an end surface of disk rotor 15 and is radially offset from the center of drive shaft 13.

A tubular boss 263 projects axially from an end surface of circular plate 261 opposite to the side thereof from which spiral element 262 extends. A discoid or short axial bushing 271 is rotatably supported in boss 263 by a bearing, such as a needle bearing 272. An eccentric hole 273 is formed in bushing 271 radially offset from the center of bushing 271. Drive pin 151 is fitted into a bearing 274 which is placed in the eccentrically disposed hole 273. Bushing 271 is therefore driven by the revolution of drive pin 151 and is permitted to rotate by needle bearing 272.

Figure 3:
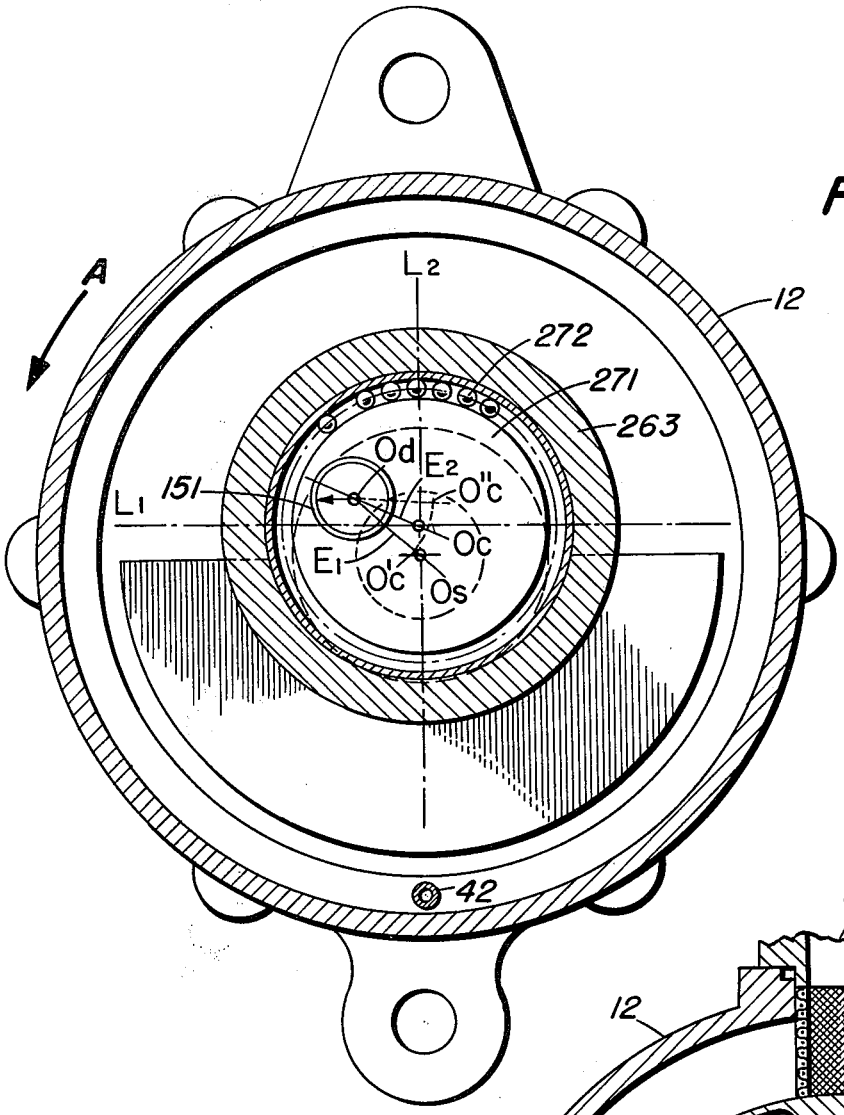
FIG. 3 is a sectional view taken along a line 3—3 in FIG. 1.

Respective placement of center Os of drive shaft 13, center Oc of bushing 271, and center Od of eccentric hole 274 and thus of drive pin 151, is shown in FIG. 3. In the position shown in FIG. 3, the distance between Os and Oc is the radius Ro of orbital motion, and when drive pin 151 is placed in eccentric hole 274, center Od of drive pin 151 is placed, with respect to Os, on the opposite side of a line L1, which is through Oc and perpendicular to a line L2 through Oc and Os, and also beyond the line L2 in a direction of rotation A of drive shaft 13.

In this construction of a driving mechanism, center Oc of bushing 271 is permitted to swing about the center Od of drive pin 151 at a radius E2, as shown in FIG. 3. Such swing motion of center Oc is illustrated as arc Oc'—Oc" in FIG. 3. This permitted swing motion allows the orbiting scroll member 26 to compensate its motion for changes in radius Ro due to wear on the spiral elements 252, 262 or due to other dimensional inaccurancies of the spiral elements. When drive shaft 13 rotates, a drive force is exerted at center Od to the left, and reaction force of fluid compression appear at center Oc to the right, both forces being parallel to line L1. Therefore, the arm Od-Oc can swing outwardly by creation of the moment generated by the two forces. Spiral element 262 of orbiting scroll member 26 is thereby forced toward spiral element 252 of fixed scroll member 25 and the center of orbiting scroll member 26 orbits with the radius Ro around center Os of drive shaft 13. The rotation of orbiting scroll member 26 is prevented by a rotation preventing/thrust bearing mechanism, described more fully hereinafter, whereby while orbiting scroll member 26 orbits it maintains its angular orientation relative to the fixed scroll member 25.

Figure 4:
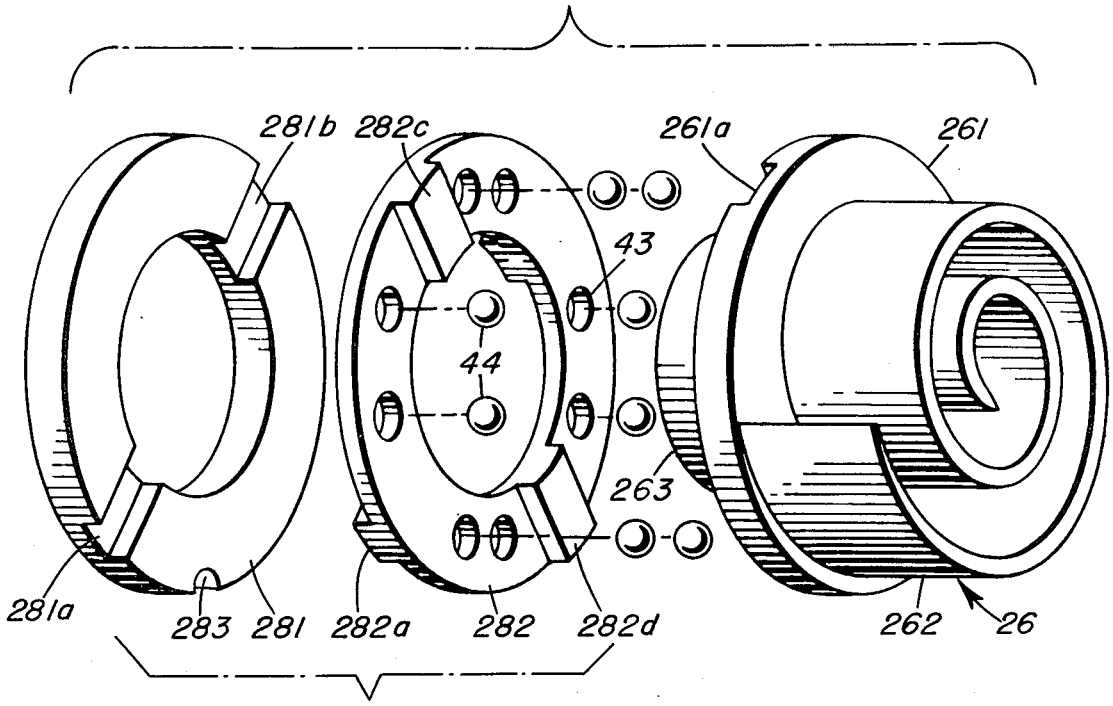
FIG. 4 is an exploded perspective view of a rotation preventing/thrust bearing mechanism of the embodiment of FIG. 1.

Referring to FIG. 4 and FIG. 1, rotation preventing/-thrust bearing mechanism 28 will be described. Rotation preventing/thrust bearing mechanism 28 surrounds boss 263 and is comprised of a fixed ring plate 281 and a sliding ring plate 282. Fixed ring plate 281 is fitted against an end surface of annular projection 112 of front end plate member 11. Fixed ring plate 281 is generally secured to the end surface of annular projection 112 by pins. If the compressor unit is provided with a connecting tube as part of an oil passageway, which construction is described more fully hereinafter, a hollow space or hole 283 is formed through the fixed ring plate 281 opposite to the connecting tube in order to allow the connecting tube to extend through it. Fixed ring plate 281 thus can be secured to the end surface of annular projection 112 by the connecting tube.

Fixed ring plate 281 is provided with a pair of keyways 281*a*, 281*b* in an axial end surface facing orbiting scroll member 26. Sliding ring plate 282 is disposed in a hollow space between fixed plate 281 and circular plate 261 of orbiting scroll member 26. Sliding ring plate 282 is provided with a pair of keys 282*a*, 282*b* on the surface facing fixed ring 281, which are received in keyway 281*a*, 281*b*. Therefore, sliding ring plate 282 is slidable in the radial direction by the guide of keys 282*a*, 282*b* within keyways 281*a*, 281*b*. Sliding ring plate 282 is also provided with a pair of keys 282*c*, 282*d* on its oppiste surface. Keys 282*c*, 282*d* are arranged along a diameter perpendicular to the diameter along which keys 282*a*, 282*b* are arranged. Circular plate 261 of orbiting scroll member 26 is provided with a pair of keyways (in FIG. 4 only one of keyway 261*a* is shown, the other keyway is disposed diametrically opposite to keyway 261*a*) on a surface facing sliding ring plate 282 in which are received keys 282*c*, 282*d*. Therefore, orbiting scroll member 26 is slidable in a radial direction by guide of keys 282*c*, 282*d* within the keyways of circular plate 261.

Accordingly, orbiting scroll member 26 is slidable in one radial direction with sliding ring plate 282, and is slidable in an other radial direction independently. The second sliding direction is perpendicular to the first radial direction. Therefore, the rotation of orbiting scroll member 26 is prevented but it is permitted to move in two radial directions perpendicular to one another.

In addition, sliding ring plate 282 is provided with a plurality of pockets or holes 43, which are formed in an axial direction. A bearing, such as balls 44 each having a diameter which is greater than the thickness of sliding ring plate 282, are retained in pockets 43. Balls 44 contact and roll on the surface of fixed ring plate 281 and circular plate 261 of orbiting scroll member 26. Therefore, the thrust load from orbiting scroll member 26 is supported on fixed ring plate 281 through balls 44.

Cup shaped casing 12 is provided with a fluid inlet port 34 and fluid outlet port 35 for connecting an external fluid circuit to suction chamber 33 and discharge chamber 32. Fluid or refrigerant gas introduced into suction chamber 33 from the external fluid circuit through inlet port 34, is taken into the fluid pockets formed between both spiral elements 252, 262. As orbiting scroll member 26 orbits, fluid in the fluid pockets is compressed and the compressed fluid is discharged into discharge chamber 32 through a hole 258 which is formed through circular plate 251 at a position near the center of spiral element 252, and therefrom, is discharged through outlet port 35 to the external fluid circuit.

Figure 5:
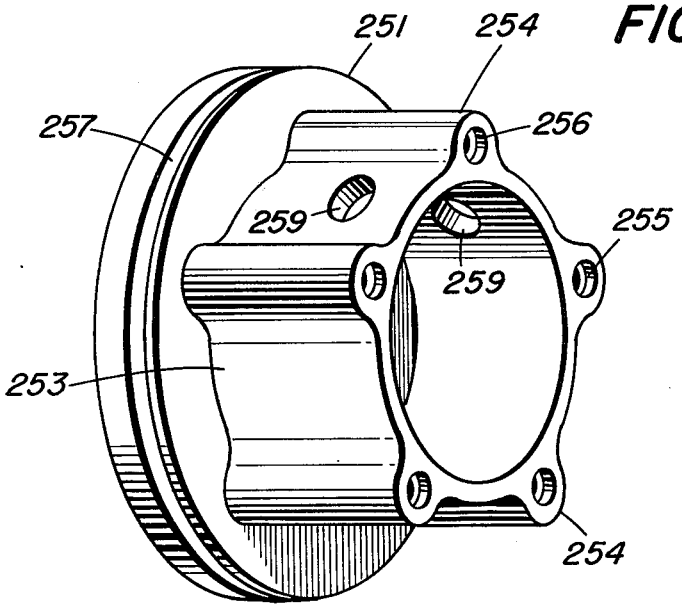
FIG. 5 is a perspective view of the fixed scroll member in the embodiment of FIG. 1.
Figure 6:
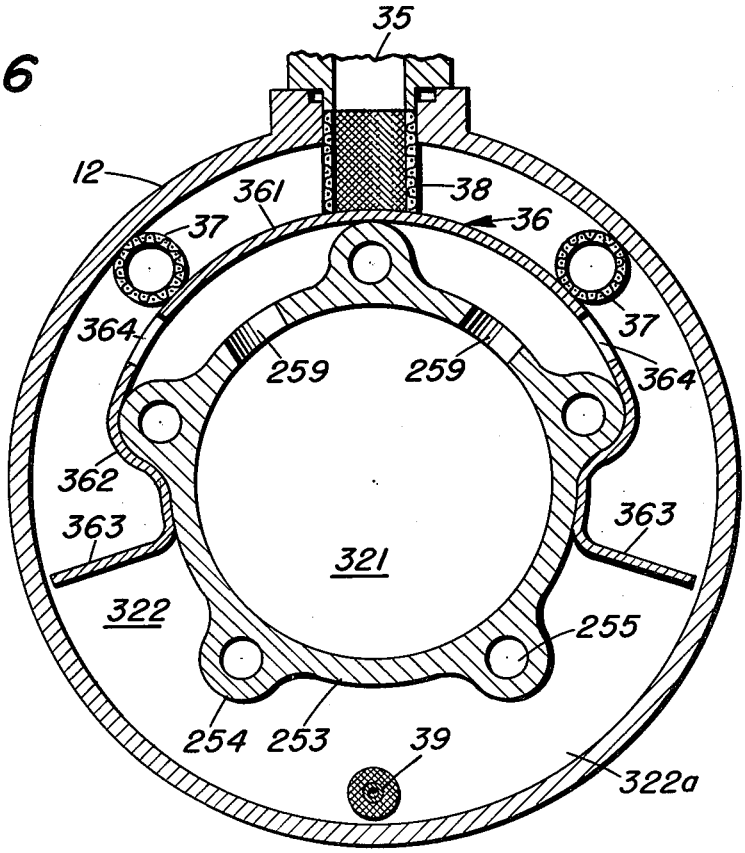
FIG. 6 is a sectional view taken along a line 6—6 in FIG. 1.

Annular partition wall 253 serves as a dividing wall to partition discharge chamber 32 into two enlarged areas or chambers, i.e., a central area or chamber 321 and an outer area or chamber 322. The areas 321, 322 are connected to one another by two holes 259 which are formed through partition wall 253, as shown in FIG. 5 or 6. Both holes 259 respectively are placed at an upper portion of partition wall 253 and are angularly displaced from outlet port 35. The partition wall 253 forms a seal along end plate portion 121 of cup shaped casing 12 is that the only fluid communication between areas 321, 322 is through holes 259.

A deflecting member for changing the direction of fluid flow is placed about the upper and outer peripheral portion of partition wall 253. The deflecting member is formed of an arc shaped deflecting plate which extends a sufficient distance to cover the upper portion of partition wall 253. In particular, the arc shaped plate of the deflecting member extends a sufficient distance so that holes 259 of partition wall 253 are covered by the deflecting member.

Referring to FIG. 6, a plate member 36 comprises the arc shaped deflecting plate 361, a fitting portion 362 and a flange member 363. Arc shaped plate 361 is positioned about the upper outer peripheral portion of partition wall 253 to contact the outer radial surface of the leg portions 254 and, hence, is spaced from the major portion of the partition wall 253 and the holes 259. A hollow space is thus formed about the holes 259 between the outer surface of the partition wall 253 and the inner surface of the plate member 36. The arc shaped plate is formed with two connecting holes 364. Connecting holes 364 respectively are placed angular displaced from holes 259 of partition 253, and serve as outlets to connect outer area 322 with central area 321. Therefore, a part of arc shaped plate 361 which extends from its uppermost portion to connecting hole 364 serves as an arc shaped deflector plate to shift the discharging fluid flow from hole 259 angularly to holes 364. Holes 364 are angularly spaced from the fluid outlet port 35 a further amount than the holes 259.

A pair of porous members 37, for example wire cloth, is placed in the hollow space between the inner surface of cup shaped casing 12 and the outer surface of plate member 36. One of the porous members 37 is located adjacent each hole 364 and at a position between a respective hole 364 and the outlet port 35. Another porous member 38 disposed in the entrance of outlet port 35 to cover the entrance thereto.

Fitting portion 362 is formed generally in the same configuration as the outer configuration of the thickened wall portions, and hence, leg portion 254. Fitting portions 362 fit against or snap about the outer surface of leg portions 254. Plate member 36 is thereby fixedly disposed about the outer periphery of partition wall 253 by fitting portions 362. An outward most section of fitting portions 362 fits against the outer surface of the major portion of the partition wall 253, and each flange portion 363 extends radially outward therefrom.

In accordance with the above construction, when drive shaft 13 is rotated by the external power source through the magnetic clutch, orbiting scroll member 26 is allowed to undergo the orbital motion through driving mechanism 27 and rotation preventing/thrust bearing mechanism 28. Thus, the fluid introduced through inlet port 34 is taken into the fluid pockets formed between both spiral elements 252, 262 and as orbiting scroll member 26 orbits, the fluid in the fluid pockets shifts to the center of both spiral elements with a consequent reduction of volume, to thereby compress the fluid in the fluid pockets. The compressed fluid is discharged into central area portion 321 of discharge chamber 32 through hole 258 of circular plate 251, and thereform discharged to the external circuit through connecting holes 259, holes 364 and outlet port 35.

A lubrication oil is carried in housing 10 to lubricate moving parts or rubbing portions, for example, bearing 16 which is supports drive shaft 13, needle bearing 272, the moving portion of rotation preventing mechanism 28, or the rubbing portions between scroll members 25, 26. During operating of the compressor unit 1, the lubrication oil splashes in the interior of housing 10 by the orbital motion of orbiting scroll member 26 and is mixed with the compressing fluid as an oil mist. The oil mist is taken into the fluid pockets together with the compressing fluid, and is therefore discharged into discharge chamber 32 through hole 258 together with the compressed fluid. The compressed fluid, which includes the oil mist, is discharged into central area 321 of discharge chamber 32 and flows out outer area 322 of discharge chamber 32 through holes 259 in partition wall 253. When the compressed fluid flows to connecting holes 259, the fluid which includes the oil mist, strikes aginst the inner surface of arc shaped deflecting plate 361 of plate member 36 and changes direction of flow. The fluid, which has had its direction of flow changed by plate 361 flows out the outer peripheral portion of plate 361 through connecting holes 364, and is discharged from outlet port 35 after passage through porous members 37, 38.

The fluid passageway from central area 321 of discharge chamber 32 to outlet port 35 is longer than a direct straight line route because of the tortuous motion or change of direction dictated by the plate 361. As the compressed fluid strikes against the arc shaped plate 361 and changes direction of flow, oil separating from the compressed fluid is promoted because oil which strikes the arc shaped plate tends to adhere to it. Further oil separation is promoted by porous member 37, 38 which function as oil separating members. Therefore, the discharge of lubrication oil with the compressed fluid is minimized.

The separated oil flows down along the outer surface of plate member 36 and collects in the lower portion of outer area 322. Flange portion 363 of plate member 36 extends slightly downward and radially outward to form a gap between the inner surface of cup shaped casing 12 and end portion of flange portion 363. Outer area 322 is thereby partitioned into two chambers by flange portion 363, and both chambers are connected through the gap between the inner surface of cup shaped casing 12 and flange portion 363. The lower chamber of outer area 322 serves as an oil sump chamber **322*a* to collect the separated oil. Flange portion 363 prevents blow back of the oil which has collected in oil sump chamber 322*a* due to the flow of the discharging fluid. The oil which has collected in oil sump chamber 322*a* is returned to suction chamber 33 through a first oil passage way 40. The passage way 40 is formed through fixed scroll member 25 and is provided with a filter member 39 at its end portion disposed in oil sump chamber 322*a***. These separated oil can thus be reutilized.

In the embodiment of the present invention as shown in FIG. 1, first oil passageway 40 is connected to a second oil passageway 113, which is formed on front end plate member 11, by a connecting tube 42, which extends through the suction chamber 33. Second oil passageway 113 communicates between suction chamber 33 and the shaft seal cavity in sleeve portion 17. One end portion of connecting tube 42 is fitted against one end opening of first oil passageway 40 and the other end portion of connecting tube 42 is fitted against one end opening of second oil passageway 113. A sealing element 421 is placed between the end surface of front end plate member 11 and fixed ring plate 281 to surround the opening of second oil passageway 113 and prevent leakage of oil. Therefore, the oil in oil sump chamber **322*a* flows into the shaft seal cavity in sleeve portion 17 through first oil passageway 40, connecting tube 42 and second oil passageway 113. Whereby shaft seal assembly 20 is lubricated by the returned oil through the oil passageways. The oil, after lubricating shaft seal assembly 20, returns to suction chamber 33 through bearing means 16. Therefore, bearing means 16** is also lubricated by the returned oil.

Connecting tube 42 extends through the interior of suction chamber 33 and one end portion of connecting tube 42 is fitted against the surface of front end plate member 11. Therefore, fixed ring plate 281 of the rotation preventing/thrust bearing mechanism requires a hole or hollow space 283 through which the tube 42 can pass. The rotation of fixed ring plate 271 is prevented by connecting tube 42. A fastening member for securing fixed ring plate 271 is not required, since connecting tube 42 performs this function. Moreover, if fixed ring plate 281 is secured in the end surface of front end plate member 11, the angular relationship between fixed scroll member 25 and orbiting scroll member 26 is established by the fixed ring plate 281. Connecting tube 42 can thus be used as a positioning pin for both scroll members 25, 26.

Referring to FIG. 7 and FIG. 8, another embodiment is shown which relates to a modification of the plate member. A plate member 41 is comprised of a flat plate portion 411, arc shaped plate 361' which acts as a deflector plate and flange member 363'. Flat plate portion 411 is placed between the axial end surface of annular partition wall 253 and end plate portion 121 of cup shaped casing 12. Flat plate portion 411 is formed integrally with arc shaped plate 361' and flange member 363'. Arc shaped plate 361' and flange member 363' are bent or extend away from flat plate portion 411 at a right angle. Flat plate portion 411 is formed with holes 412 which align with tapped holes 255 of partition wall 253. Screws 29 extend through holes 412 and thread into holes 255. Plate member 41 is thereby fixed to the inner surface of end plate portion 121 together with fixed scroll member 25. The plate member 41 functions in the same manner as the plate member 36 with the gap between the outermost edges of the arc shaped portion 361' and the adjacent leg portions 254 functioning as an outlet as did holes 364. The above construction of plate member 41 has the advantage that it can be easily and simply produced.

Figure 9:
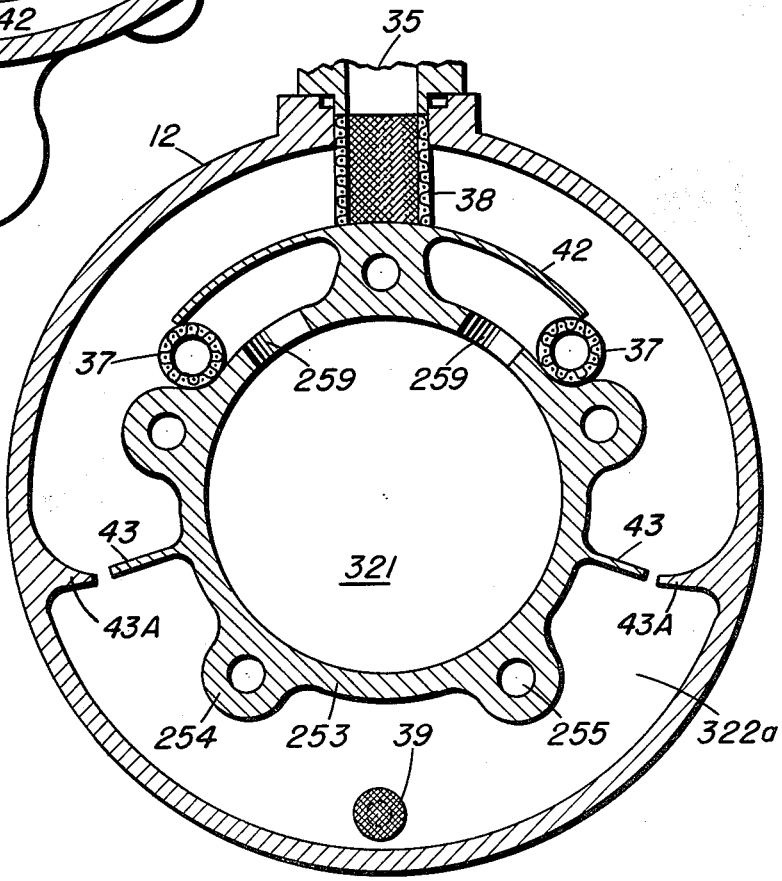
FIG. 9 is a sectional view similar to FIG. 6 of a compressor according to still another embodiment of this invention.

Referring to FIG. 9, still another embodiment is shown which relates to a modification of the plate member. The partition wall 253 of fixed scroll member 25 is formed integral with an arc shaped plate 42 which acts as a deflector plate and flange member 43. Porous member 37 is placed between the outer surface of partition wall 253 and the inner surface of arc shaped plate 42. However, these porous members 37 don't necessarily have to be placed between arc shaped plate 42 and partition wall 253, they may be placed between the inner surface of cup shaped casing 12 and arc shaped plate 42 as shown in FIG. 6 or FIG. 7. Also, flange portion 43 does not necessarily have to be formed on partition wall 253. A flange portion **43*a* may be formed on the inner surface of cup shaped casing 12 of formed on the both surfaces, as shown in FIG. 9. In accordance with the above construction, if fixed scroll member 25 or cup shaped casing 12** is formed from a die casting of aluminum alloy, these plate members can be easily made by aluminum alloy die casting.

This invention has been described in detail in connection with preferred embodiments, but these are examples only, and this invention is not restricted thereto. It will be easily understood by those skilled in the art that other variations and modifications can be easily made within the scope of this invention.

I claim:

1. In a scroll type fluid displacement apparatus including a housing having a fluid inlet port and a fluid outlet port, a fixed scroll member fixedly disposed within said housing and having a first end plate from which a first involute wrap extends, an orbiting scroll member having a second end plate from which a second involute wrap extends, said first and second wraps interfitting at an angular and radial offset to make a plurality of line contacts to define at least one pair of sealed off fluid pockets, driving means for effecting the orbital motion of said orbiting scroll member while the rotation of said orbiting scroll member is prevented, whereby said fluid pockets change volume by the orbital motion of said orbiting scroll member, the improvement comprising a discharge chamber located inside the housing and adjacent said fixed scroll member on the side of said first end plate opposite the side thereof from which said first wrap extends, said first end plate having a discharge bore therethrough communicating between said fluid pocket near the center of said first wrap and said discharge chamber, a dividing wall disposed in said discharge chamber for partitioning said discharge chamber into two partition chambers, said dividing wall having at least one hole for providing fluid communication between said two partition chambers, deflecting means including a generally arc shaped plate disposed in an area between an interior surface of said housing and an exterior surface of said dividing wall, said arc shaped plate being located in said area such that fluid discharging through said at least one hole in said dividing wall moves in a direction away from said fluid outlet port and thereafter in a direction toward said fluid outlet port, and at least one oil separating member for separating lubricating oil from the fluid discharging from said fluid pockets, said at least one oil separating member being disposed in a fluid passageway between the fluid outlet port and said discharge bore.

2. A scroll type fluid displacement apparatus of claim 1 wherein two angularly spaced holes are formed through said dividing wall, one of said last-mentioned holes being disposed to one side of said fluid outlet port and the other of said last-mentioned holes being disposed to the other side thereof, said arc shaped plate having a pair of outlets through which the fluid flows as it changes direction, one of said pair of outlets being disposed angularly further away from said fluid outlet port than a first of said holes through said dividing wall and the other of said pair of outlets being disposed angularly further away from said fluid outlet port than the other of said holes through said dividing wall.

3. A scroll type fluid displacement apparatus of claim 1 or 2 wherein said dividing wall has a generally annular configuration.

4. A scroll type fluid displacement apparatus of claim 4 wherein said dividing wall is formed integral with said first end plate.

5. A scroll type fluid displacement apparatus of claim 1 or 2 including a flange member disposed in the area between the inner surface of said housing and the outer surface of said dividing wall for preventing the blow back of oil separated from the fluid being discharged.

6. A scroll type fluid displacement apparatus of claim 1 or 2 wherein said dividing wall has a plurality of thickened wall portions, and a tapped hole formed axially in each of said thickened wall portions into which screws are threaded to attach said dividing wall to said housing.

7. A scroll type fluid displacement apparatus of claim 6 wherein a fitting portion extends from either end of said arc shaped plate, and has an inner surface mating with the outer surface of said thickened portion, said arc shaped plate being fixedly disposed above the outer surface of said dividing wall by fitting said fitting portions about adjacent ones of said thickened portions of said dividing wall.

8. A scroll type fluid displacement apparatus of claim 7 wherein a flange member extends from said fitting portion for preventing the blow back of oil separated from the fluid being discharged.

9. A scroll type fluid displacement apparatus of claim 8 wherein said arc shaped plate, said fitting portion and said flange member are integrally formed.

10. A scroll type fluid displacement apparatus of claim 1 or 2 including a flat plate disposed between an end surface of said dividing wall and an inner surface of said housing, said arc shaped plate extending from said flat plate and a flange member extending from said flat plate for preventing the blow back of oil separated from the fluid being discharged.

11. A scroll type fluid displacement apparatus of claim 1 or 2 wherein said arc shaped plate is formed integral with said dividing wall.

12. A scroll type fluid displacement apparatus of claim 11 including a flange member disposed in the area between the inner surface of said housing and the outer surface of said dividing wall for preventing blow back of oil separated from the fluid being discharged.

13. A scroll type fluid displacement apparatus of claim 12 wherein said flange member is formed integral with said dividing wall.

14. A scroll type fluid displacement apparatus of claim 12 wherein said flange member is formed integral with said housing.

15. A scroll type fluid displacement apparatus of claim 12 wherein said flange member is formed integral with said annular wall and said housing.

16. A scroll type fluid displacement apparatus of claim 7 wherein said at leat one oil separating member is disposed between the inner surface of said housing and outer surface of said arc shaped plate.

17. A scroll type fluid displacement apparatus of claim 10 wherein said at least one oil separating member is disposed between the inner surface of said housing and an outer surface of said arc shaped plate.

18. A scroll type fluid displacement apparatus of claim 11 wherein said at least one oil separating member is disposed between an inner surface of said arc shaped plate and an outer surface of said dividing wall.

19. A scroll type fluid displacement apparatus of claim 16 wherein another oil separating member is disposed at said fluid outlet port.

20. A scroll type fluid displacement apparatus of claim 17 wherein another oil separating member is disposed at said fluid outlet port.

21. A scroll type fluid displacement apparatus of claim 18 wherein another oil separating member is disposed at said fluid outlet port.

22. A scroll type fluid displacement apparatus of claim 1 or 2 wherein a first oil passageway is formed through said fixed scroll member and communicates between said discharge chamber and a suction chamber containing said orbiting scroll member.

23. A scroll type fluid displacement apparatus of claim 22 wherein a second oil passage way is formed through a front end plate of the housing and communicates with said suction chamber and a seal cavity of the driving means and a connecting member is disposed between said first and second oil passageways whereby separated oil is transfered from said discharge chamber to said seal cavity.

24. A scroll type fluid displacement apparatus of claim 23 wherein said connection member extends through said suction chamber.

25. A scroll type fluid displacement apparatus of claim 24 wherein a fixed plate member of a means for preventing the rotation of the orbiting scroll member is formed with a hollow portion through which said connecting tube extends.

26. A scroll type fluid displacement apparatus of claim 22 wherein said oil passageway is provided with a filter member which is disposed in said discharge chamber.

27. A scroll type fluid displacement apparatus comprising:

a housing comprising a cup shaped casing and a front end plate member, a fluid inlet port and a fluid outlet port formed through said casing;

a fixed scroll member fixedly disposed with said housing and having a first end plate from which a first involute wrap extends, an annular wall projecting from an end surface of said first end plate on opposite side thereof from which said first wrap extends, said annular wall having a plurality of thickened wall portions, and at least one hole therethrough, a tapped hole being formed in said thickened portions into which screws are screwed to attach said cup shaped casing to said fixed scroll member;

an orbiting scroll member movably disposed within said housing and having a second end plate from which a second involute wrap extends, said first and second wraps interfitting at an angular and radial offset to make a plurality of line contacts to define at least one pair of sealed off fluid pockets;

a drive shaft penetrating said front end plate member and being rotatably supported by said front end plate member;

means for connecting said drive shaft to said orbiting scroll member for transmitting orbital motion to said orbiting scroll member;

means for preventing the rotation of said orbiting scroll member while it orbits;

said first end plate partitioning the interior of said housing into a suction chamber and a discharge chamber and said annular wall projecting into said discharge chamber to partition said discharge chamber into first and second areas, and a bore formed through said first end plate to provide communication between said suction and discharge chambers for fluid discharging from said fluid pockets into said discharge chamber;

deflecting means for deflecting the flow of fluid discharging from said fluid pockets, said deflecting means including an arc shaped plate extending over said hole of said annular wall; and at least one first oil separating member disposed in a fluid passageway between said fluid outlet port and said bore through said first end plate.

28. A scroll type fluid displacement apparatus of claim 27 wherein said arc shaped plate is disposed in an area between an interior surface of said housing and an exterior surface of said annular wall, said arc shaped plate being located in said area such that fluid discharging through said at least one hole in said annular wall moves in a direction away from said fluid outlet port and thereafter in a direction toward said fluid outlet port.

29. A scroll type fluid displacement apparatus of claim 28 wherein two angularly spaced holes are formed through said annular wall, one of said last-mentioned holes being disposed to one side of said fluid outlet port and the other of said last mentioned holes being disposed to the other side thereof, said arc shaped plate having a pair of outlets through which the fluid flows as it changes direction, one of said pairs of outlets being disposed angularly further away from said fluid outlet port then a first of said holes through said annular wall and the other of said pair of outlets being disposed angularly further away from fluid outlet port than the other of said holes through said annular wall.

30. A scroll type fluid displacement apparatus of claim 27, 28 or 29 including a flange member disposed in the area between the inner surface of said housing and said annular wall for preventing the blow back of oil separated from the fluid being discharged.

31. A scroll type fluid displacement apparatus of claim 30 wherein a fitting portion extends from either end of said arc shaped plate and has an inner surface mating with the outer surface of said thickened portion, said arc shaped plate being fixedly disposed above the outer surface of said annular wall by fitting said fitting portion about adjacent ones of said thickened portions of said annular wall.

32. A scroll type fluid displacement of claim 31 wherein said flange member extends from said fitting portion.

33. A scroll type fluid displacement apparatus of claim 32 wherein said arc shaped plate, said fitting portion and said flange member are integrally formed.

34. A scroll type fluid displacement apparatus of claim 28 or 29 including a flate plate disposed between an end surface of said annular wall and an inner surface of said housing, said arc shaped plate extending from said flate plate and a flange member extending from said flat plate for preventing the blow back of oil separated from the fluid being discharged.

35. A scroll type fluid displacement apparatus of claim 28 or 29 wherein said arc shaped plate is formed integral with said annular wall.

36. A scroll type fluid displacement apparatus of claim 35, including a flange member disposed in the area between the inner surface of said housing and the outer surface of said annular wall for preventing blow back of oil separated from the fluid being discharged.

37. A scroll type fluid displacement apparatus of claim 36 wherein said flange member is formed integral with said annular wall.

38. A scroll type fluid displacement apparatus of claim 36 wherein said flange member is formed integral with said cup shaped casing.

39. A scroll type fluid displacement apparatus of claim 36 wherein said flange member is formed integral with said annular wall and said cup shaped casing.

40. A scroll type fluid displacement apparatus of claim 28 or 30 wherein said at least one oil separating member is disposed between an inner surface of said cup shaped casing an an outer surface of said arc shaped plate.

41. A scroll type fluid displacement apparatus of claim 40 wherein a second oil separating member is disposed at said fluid outlet port.

42. A scroll type fluid displacement apparatus of claims 28 or 29 wherein said at least one oil separating member is disposed between an inner surface of said arc shaped plate and an outer surface of said annular wall.

43. A scroll type fluid displacement apparatus of claim 42 wherein a second oil separating member is disposed at said fluid outlet port.

44. A scroll type fluid displacement apparatus of claim 28 or 29 wherein a first oil passageway is formed through said fixed scroll member and communicates between said discharge chamber and said suction chamber.

45. A scroll type fluid displacement apparatus of claim 44 wherein a second oil passageway is formed through said front end plate member and communicates between said suction chamber and a seal cavity about said drive shaft, and a connecting member is disposed between said first and second oil passageways, whereby separated oil is transfered from said discharge chamber to said seal cavity.

46. A scroll type fluid displacement apparatus of claim 45 wherein said connecting member extends through said suction chamber.

47. A scroll type fluid displacement apparatus of claim 46 wherein a fixed member of said rotation preventing means is formed with a hollow portion through which said connecting member extends.

48. A scroll type fluid displacement apparatus of claim 47 wherein a seal element is placed between the axial end surface of said front end plate member and said fixed member of said rotation preventing means for surrounding the opening of said second oil passageway.

49. A scroll type fluid displacement apparatus of claim 46 wherein said oil passageway is provided with a filter member which is disposed in said discharge chamber.

* * * * *

UNITED STATES PATENT AND TRADEMARK OFFICE

CERTIFICATE OF CORRECTION

PATENT NO. : 4,470,778

DATED : September 11, 1984

INVENTOR(S) : Atsushi Mabe

It is certified that error appears in the above—identified patent and that said Letters Patent is hereby corrected as shown below:

Col. 1, line 41, "genrerally" should be —generally—;

Col. 3, line 21, "scrolltype" should be —scroll type—;

Col. 6, line 5, "oppiste" should be —opposite—;

Col. 8, line 4, "aginst" should be —against—;

Col. 8, line 17, "separating" should be —separation—;

Claim 16, col. 11, line 38, "leat" should be —least—;

Claim 34, col. 13, line 35, "flate" should be —flat—;

line 38, "flate" should be —flat—; and

Claim 40, col. 14, line 8, "30" should be —29—.

Signed and Sealed this

*Nineteenth* Day of *February 1985*

[SEAL]

*Attest:*

DONALD J. QUIGG

*Attesting Officer* *Acting Commissioner of Patents and Trademarks*